United States Patent [19]

Smith

[11] 4,432,175

[45] Feb. 21, 1984

[54] POST-TENSIONED CONCRETE SLAB

[76] Inventor: Rodney I. Smith, Midland, Va. 22728

[21] Appl. No.: 234,730

[22] Filed: Feb. 17, 1981

[51] Int. Cl.[3] ..... E04B 1/06

[52] U.S. Cl. ..... 52/224; 52/223 R

[58] Field of Search ..... 52/223 R, 223 L, 224, 52/741; 24/122.6

[56] References Cited

U.S. PATENT DOCUMENTS

| | | | |
|---|---|---|---|
| 3,673,644 | 7/1972 | Howlett et al. | 52/223 L |
| 3,869,530 | 3/1975 | Williams | 52/224 X |
| 3,950,840 | 4/1976 | Dietrich | 52/224 X |
| 4,045,929 | 9/1977 | VeloDalbrenta | 52/224 |
| 4,185,440 | 1/1980 | Finsterwalder | 52/223 R |

*Primary Examiner*—J. Karl Bell

[57] ABSTRACT

A method and apparatus for post-tensioning a concrete slab. A tendon member is pre-formed to define an enclosed area yet fit within a form. The tendon member has ends which extend past the form. Concrete is poured around the tendon with the tendon being positioned within the periphery of the concrete structure to form a large central area bounded by the tendon and an exterior portion which surrounds the enclosed area of the tendon. The tendon is anchored within said concrete by anchors secured to the ends of the said tendon and placed under an original tension of around 28,000 p.s.i.

7 Claims, 5 Drawing Figures

POST-TENSIONED CONCRETE SLAB

BACKGROUND OF THE INVENTION

Long before the invention of portland cement, which led to the extensive utilization of concrete as a construction material, various reinforcement techniques were well known as a means of adding strength and stability to plaster, adobe and other such early cementious materials. These techniques were quickly adapted, modified and improved along with the growing use of concrete, which, while highly resistant to compressive force, lacks the tensile strength required for many construction uses. Reinforcement adds the necessary tensile strength.

The most common technique for reinforcing concrete involves the suspension of wire mesh or steel rods in the form or mold into which the liquid concrete is poured and cured.

Over the past half-century increasing use has been made of prestressed concrete, in which reinforcing tendons, generally of such high tensile strength material as hard drawn steel rods or cables, are stretched or tensioned within the form or mold either before the concrete is poured or after it is poured but still ductile. The tension of the prestressed tendons exerts a tensile force on the surrounding concrete imparting to it a tensile strength vastly superior to that of ordinary reinforcement rods. Among the advantages of prestressing, is the fact that less concrete is required in a prestressed beam or slab thus reducing its weight.

Prestressing, as currently practiced, is divisible into two general techniques; pretensioning and post-tensioning.

In pretensioning, the tendons are tensioned either before or immediately after the concrete is poured. One end of each tendon is anchored to one wall of the mold, extended across the mold and through the opposite wall. Either before the concrete is poured, or (more commonly) immediately after, the tendon is stretched or tensioned by a hydraulic jack or any other means of exerting a tensioning force on the unanchored end of the tendon which is extended through the wall of the mold. When optimum tension has been reached, the unanchored end of the tendon is anchored to the mold wall through which it extends. Since the liquid concrete offers little resistance to plastic deformation, the opposite walls of the mold must sustain the entire tensile force of the tendon stretched between them. When multiple tendons are employed, the tensile force is multiplied and the mold walls must be extremely rigid to resist bending or deforming. Such rigid forms or molds are expensive, cumbersome and require great care and skill in preparation and use. Because of this, pretensioning is generally practical only in factory casting, where the mold need not be moved and can be used again and again to form concrete structures of the same shape.

Pretensioning has one other characteristic disadvantage. A tendon can only extend in a straight line between its opposite anchored ends. It cannot generally be effectively employed in forming a curved slab or arcuate beam.

In post-tensioning, each tendon is positioned in the mold before the concrete is poured; but, unlike a pretensioned tendon, it is heavily coated with grease or some similar heavy lubricant which will prevent the concrete from adhering to the tendon. In most modern applications, the tendon is not only lubricated but surrounded by a plastic hose or sheath to assure that it will not become adhered to the concrete and will remain easily movable within the channel formed by the plastic sheath within the concrete even after the concrete has cured and hardened.

In contrast to pretensioning, the post-tensioned tendon remains inert, untensioned, while the concrete is very ductile.

It should be appreciated, at this point, that concrete is poured as a liquid and sets within twenty four hours into a relatively solid form, but the curing process takes much longer and even after a week the concrete is to some extent ductile. Even after many months and after being fully cured, concrete remains capable of some flow characteristics in response to forces exterted upon it.

In post-tensioning, the tendons are tensioned a week or so after the concrete has been poured, when the concrete is relatively solid and the form or mold has been removed. One end of the tendon is anchored to one end of the concrete structure through which it extends and the other end of the tendon which extends beyond the concrete structure is pulled by a hydraulic jack, or other means of exerting a tensioning force, until it has reached optimum tension and then the unanchored end of the tendon is anchored to the concrete structure at the point from which it extends.

Post-tensioning overcomes the two aforementioned characteristic disadvantages of pretensioning.

Because post-tensioned tendons are tensioned after the concrete is relatively solid, and the mold removed, a simple, inexpensive form or mold may be used, sufficient merely to contain the concrete while it is setting and curing and not necessarily so strong and rigid as to sustain the tensile force of pretensioned tendons. Such forms can be easily and inexpensively constructed on the site with less care and skill than required of a mold for pretensioned concrete.

Also because post-tensioned tendons are tensioned after the concrete is relatively solid, they do not necessarily have to extend in a straight line between their opposite anchored ends, but may be used to impart tensile strength to a curved or arcuate concrete structure. There are, however, limits as to the degree of curvature to which the application of post-tensioning is practical. In an extremely arcuate U-shaped beam, or hollow cylindrical shape like a culvert, the force exerted by tensioned tendons becomes counter-productive. The tensile force of such extremely curved tendons rather than imparting end-to-opposite-end tensile strength, work against the curvature of the structure tending to pull outwardly the legs of the U-shaped beam or collapse the walls of a culvert.

One of the principal problems in post-tensioning is the loss of tension due to "creep", which includes both creep of the tendon and creep of the anchor.

Creep of the tendon involves a relatively minor loss as the steel tendon gradually deforms in response to the tension.

Creep of the anchor involves a much more substantial loss. It results from both the anchor losing its grip on the tendon and from the loss of tension between the application of the anchoring device and its settling into the concrete structure. For instance, one anchoring device (referred to later herein and illustrated in FIGS. 4 and 5 of the Drawings) is a longitudinally divisible, two piece cylinder having gripping teeth or grooves on its inner periphery and being frusto-conically shaped on its outer periphery. When the tendon has been stretched to the optimum tension, the anchoring device is applied and held to that portion of the tendon that extends immediately beyond concrete structure, then as the tensioning force is released, the anchoring device is pulled by the tension of the tendon into the adjacent channel formed in the concrete structure. As it is pulled into the opening of the channel and due to its frusto-conical shape, with the smaller end of the device toward the channel, the device wedges into place driving the gripping teeth or grooves into the tendon and locking or anchoring the previously unanchored end of the tendon. During the process of applying the anchoring device, releasing the tension on the tendon, and allowing the anchoring device to settle into the opening of the adjacent channel, a significant loss of tension occurs.

Two factors control the amount of tension that can be applied to a tendon; the tensile strength of the tendon and the concrete's resistance to compressive force. Given concrete's relatively high resistance to compressive force and what is economically feasible for the material of which the tendon is formed, the controlling factor is generally the tensile strength of the tendon. While there are obviously variables in the two factors which define the optimum tension, as applied to the most commonly used hard drawn steel rods or cables, optimum tension is achieved at around 28,000 p.s.i. Once this optimum tension has been reached, the anchoring device applied and the tension released, the tension is diminished by the amount of loss due to creep which is principally the result of the anchoring process as descibed above.

It is important to appreciating the background of the present invention to understand that the anchor creep loss remains the same regardless of the length of the tendon, although the stretch of the tendon increases in direct proportion to is length. For instance, if a 100 foot tendon stretches 10 inches at 28,000 p.s.i. and loses 2 inches to anchor creep, there is only a 20% reduction in its tensile force. But if a 40 foot tendon stretches 4 inches and loses two inches to anchor creep, there is a 50% reduction in its tensile force. In a 20 foot tendon, the anchor creep loss equals the tension and the resulting concrete structure is merely reinforced and not post-tensioned. Therefore, post-tensioning has, in the past, been impractical for use in forming relatively small concrete forms. For a slab less than 20 feet across it is useless.

SUMMARY OF THE INVENTION

The present invention pertains generally to post-tensioning and more specifically to a technique in which one or more continuous reinforcement tendons are positioned in a mold, around and near its outer periphery and lubricated and/or sheathed to prevent adherence to the concrete. The concrete is poured and cured; each tendon is post-tensioned and anchored. The tensile force of each tendon is therefore exerted toward the center of the slab as well as from side to opposite side. This results in a slab that can be relatively small and lightweight, but has high strength, resistance to cracking and deterioration, and is relatively impermeable to liquids and gases.

It is the object of the present invention to overcome the aforementioned disadvantages of both pretensioning and post-tensioning, specifically the rigid mold and straight line tendon requirement of pretensioning and the inapplicability of post-tensioning to relatively small structures.

It is a further object to provide a method which minimizes the creep loss in post-tensioning and a method of forming, inexpensibly, a relatively small post-tensioned concrete slab, with the resultant advantages of lightweight, high tensile strength, resistance to cracking and deterioration and impermeability to liquids and gases.

These objects and other advantages will become apparent with the understanding of the present invention, an embodiment of which is described in the following description of drawings, in which;

DETAILED DESCRIPTION OF THE DRAWINGS

Figure 2:
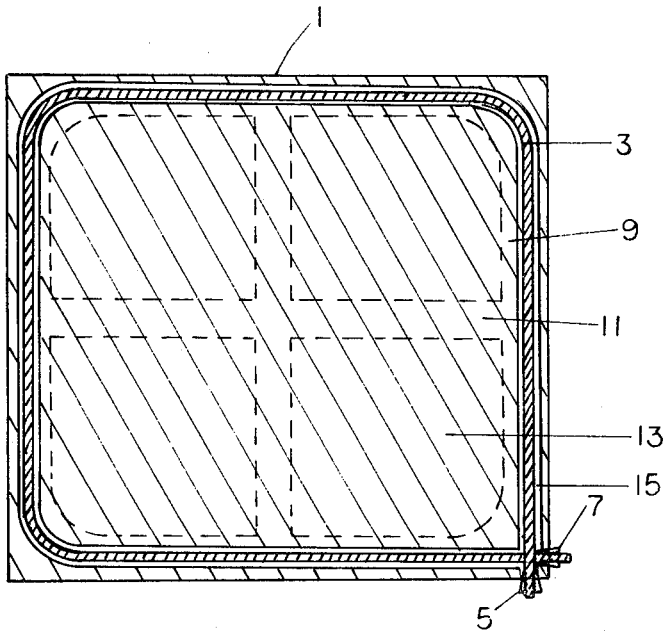
FIG. 2 is a sectional view taken at line A—A' of FIG. 1.
Figure 1:
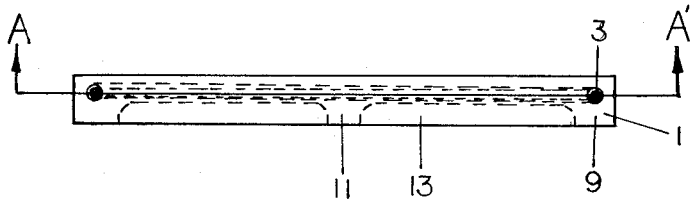
FIG. 1 is an elevated side view of the concrete structure embodying the invention, shown partly in phantom.

According to the invention, a post-tensioned concrete slab indicated generally at 1 of FIGS. 1 and 2, is provided with a post-tensioned tendon 3 toward its outer periphery. The tendon 3 is a hard drawn steel cable, but any relatively flexible high-tensile strength material can be similarly employed.

The opposite ends of tendon 3 are secured by anchors 5 and 7.

The slab 1 is comprised of an enlarged peripheral portion 9. Within peripheral portion 9, and extending inwardly from the center of its opposite sides is enlarged cross piece 11. As will be noted from FIG. 1, cross piece 11 and peripheral portion 9 are the same approximate thickness. In the quadrants formed by cross piece 11 within peripheral portion 9, are concaved areas 13.

The tendon 3, is within a plastic sheath 15 which forms a channel extending around and approximately through the center of peripheral portion 9. Tendon 3 may be lubricated to facilitate its movement within sheath 15.

Figure 3:
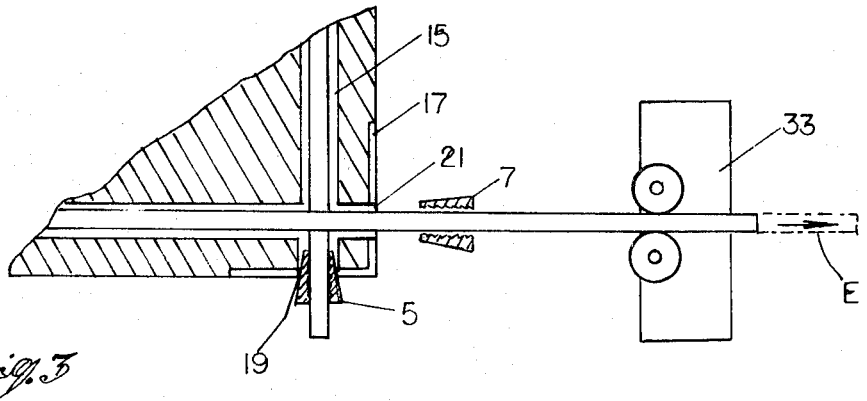
FIG. 3 is an enlarged view of a portion of FIG. 2 showing the tensioning of the tendon.

The post-tensioning process is illustrated in FIG. 3. When the concrete, which forms slab 1, is poured, the sheath 15 and tendon 3 are positioned so that the opposite ends of tendon 3 extend outwardly from adjacent sides of the same corner. This corner is also provided with a steel corner plate 17, which has apertures 19 and 21, defined therein, which are in registery with the openings to the channels defined by the opposite ends of sheath 15.

After the concrete has become relatively hardened (approximately twenty four hours after it has been poured) there is an initial tensioning of tendon 3. This initial tensioning adds stripping strength to the slab—that allows the mold to be removed more easily and with minimal surface deterioration. After this initial tensioning, the mold is removed and anchor 5 is applied to one end of the tendon 3.

Figure 4:
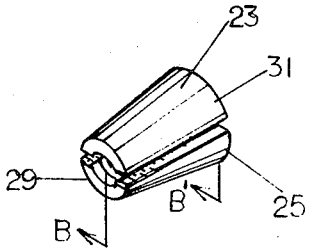
FIG. 4 is an elevated perspective view of the anchor device of the invention.
Figure 5:
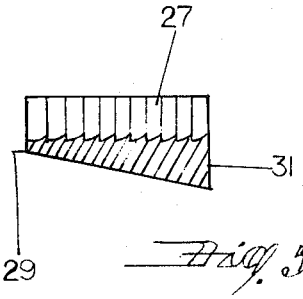
FIG. 5 is sectional view of the bottom half of the anchor device taken at line B—B' of FIG. 4.

Anchors 5 and 7 are illustrated in FIGS. 4 and 5. Each anchor comprises a top half 23 and bottom half 25. Each anchor 5 and 7 is frusto-conically shaped having small end 29 and large end 31. The anchor bottom half 25, which is further illustrated in FIG. 5, has teeth or grooves 27, which are sloped away from its small end 29.

When anchor 5 is applied to the one end of tendon 3, the other end of tendon 3 is engaged by tensioning means 33. Tensioning means 33, which can be a hydraulic jack or any other device for pulling the tendon 3 in the direction indicated by the arrow E in FIG. 3, exerts a tensioning force on tendon 3 until the optimum tension of approximately 28,000 p.s.i. is attained. This tensioning of the tendon 3, draws anchor 5 into the aperture 19 and the channel formed by the adjacent end of sheath 15, thereby anchoring that end of tendon 3. While tendon 3 is so tensioned, anchor 7, which is identical to anchor 5, is applied to the end of tendon 3 which extends beyond aperture 21. Anchor 7, like anchor 5 during tensioning can be held to tendon 3 manually or by any conventional clamping means. Tensioning means 33 is then released and the result-tensile force of tendon 3 draws the anchor 7 into aperture 21 and the adjacent channel formed by sheath 15.

The tensioning process, illustrated in FIG. 3, results in the post-tensioned slab 1, illustrated in FIGS. 1 and 2. The tendon 3 forms a rectangular configuration having gently curved corners at all but the corner where its opposite ends are anchored. These curved corners and the lubricant between sheath 15 and tendon 3 assure that the tension applied to tendon 3 will be evenly distributed throughout its length. Therefore, the tensile force of tensioned tendon 3 is exerted not only from corner to corner but also inwardly toward the center of cross piece 11. It will be appreciated that the enlarged portions of slab 1, which are peripheral portion 9 and cross piece 11, are enlarged to increased the concrete's resistance to the compressive forces exerted by the tensile force of the post-tensioned tendon 3. The concaved areas 13 reduce the bulk and weight of slab 1.

It will be further appreciated that, unlike conventional side-to-opposite-side tendons, the present invention's tendon 3 is continuous through the peripheral portion 9, thereby increasing its length to four times that of the conventional tendons. As a result of this invention, the effective loss of tension due to creep of anchor is portionally decreased. For instance, in forming a slab that is 20 feet by 20 feet, conventional 20 foot tendons could not be effectively post-tensioned because the anchor creep loss would neutralize the tension. But, employing the present invention, the loss of tension due to anchor creep is proportionally diminished because the length of the tendon is greater. While this is particularly useful in forming smaller slabs, where post-tensioning would be otherwise impossible, it is also applicable to larger slabs, since it increases the length of the tendon and, therefore, decreases the proportionate loss of tension due to anchor creep.

A reinforcement element is utilized to strengthen the concrete immediately adjacent the anchors. In the present embodiment, a corner plate 17 has been found to be a desirable means of distributing the tensile force of tendon 3 over a larger area and preventing deterioration and cracking in the corner where the opposite ends of tendon 3 are anchored.

In the specific embodiment described above, the tendon and sheath are positioned within the mold before the concrete is poured. However, in some circumstances, the sheath without the tendon might be positioned in the mold or by some other means a channel formed in the mold or by some other means a channel formed corresponding to the position of sheath as illustrated. Then, after the concrete is cured, the tendon inserted into the sheath or channel and post-tensioned as described above.

Although only one embodiment of the present invention has been shown and described, it is obvious that other adaptations and modifications to this invention can be made without departing from the true spirit and scope of this invention.

What is claimed:

1. A post-tensioned concrete slab assembly comprising a concrete slab, a tendon member, and a pair of anchor means, said tendon member being pre-formed in a loop to define an enclosed area within said slab, said tendon member having ends adjacent one another which extend outside said slab, the tendon member being positioned within the periphery of said slab to form said enclosed area bounded by the tendon member and an exterior slab portion surrounding the enclosed area of the tendon member, said anchor means being secured to the ends of said tendon member so that said tendon member is placed under an original tension of around 28,000 p.s.i.

2. A slab assembly as claimed in claim 1 further comprising a steel corner plate placed in one corner of said concrete slab, said corner plate defining a plurality of holes therein which are aligned with said tendon member ends allowing said tendon member ends to project therethrough to distribute the tensile force of the tendon member over a large area of the structure preventing deterioration and cracking in the corner where the tendon member is anchored.

3. A slab assembly as claimed in claim 1 wherein said tendon member is lubricated along its length within said slab.

4. A slab assembly as claimed in claim 1 further comprising a sheath and wherein said tendon member is covered by said sheath within said slab.

5. A slab assembly as claimed in claim 1 wherein said tendon member forms a substantially rectangular configuration having three gently curved corners and a fourth corner where the tendon member ends are anchored.

6. A slab assembly as claimed in claim 1 wherein said slab has enlarged concave surface area portions to reduce the weight of the slab and to increase the resistance of the slab to compressive forces.

7. A post-tensioned concrete slab assembly comprising a corner plate, a concrete slab, a sheathed tendon, and a pair of tendon end anchoring means, said concrete slab being hardened over said sheathed tendon having ends overlapping to define a loop, said loop defining within said slab a large interior portion bounded by said loop and a small exterior portion surrounding said loop, said loop being post-tensioned and anchored in said slab by said anchoring means secured on each end of said tendon engaging said corner plate positioned on a corner of said slab, said slab being formed with an enlarged peripheral portion and a cross piece extending to said peripheral portion to increase the resistance of the slab to compressive forces exerted by the tensile force of the post-tensioned loop.

* * * * *